United States Patent [19]

Shanks

[11] 4,300,189

[45] Nov. 10, 1981

[54] SEALED BEAM LAMP UNIT HAVING BONDED TERMINALS

[75] Inventor: Bruce E. Shanks, Chesterland, Ohio

[73] Assignee: General Electric Company, Schenectady, N.Y.

[21] Appl. No.: 105,955

[22] Filed: Dec. 21, 1979

[51] Int. Cl.[3] ..... F21V 7/00

[52] U.S. Cl. ..... 362/267; 362/80; 362/310

[58] Field of Search ..... 362/80, 267, 310

[56] References Cited

U.S. PATENT DOCUMENTS 3,917,939 11/1975 Schmidt et al. ..... 362/267

*Primary Examiner*—Stephen J. Lechert, Jr.

*Attorney, Agent, or Firm*—Lawrence R. Kempton; Philip L. Schlamp

[57] ABSTRACT

A sealed beam headlamp having a lamp terminal formed from a closed end eyelet which is inserted within a lug for forming a metal barrier which is bonded within an envelope opening. The lamp terminal is impervious to moisture and closely fits the envelope opening with voids between the terminal and the envelope being filled by a sealant.

15 Claims, 5 Drawing Figures

Fig. 1
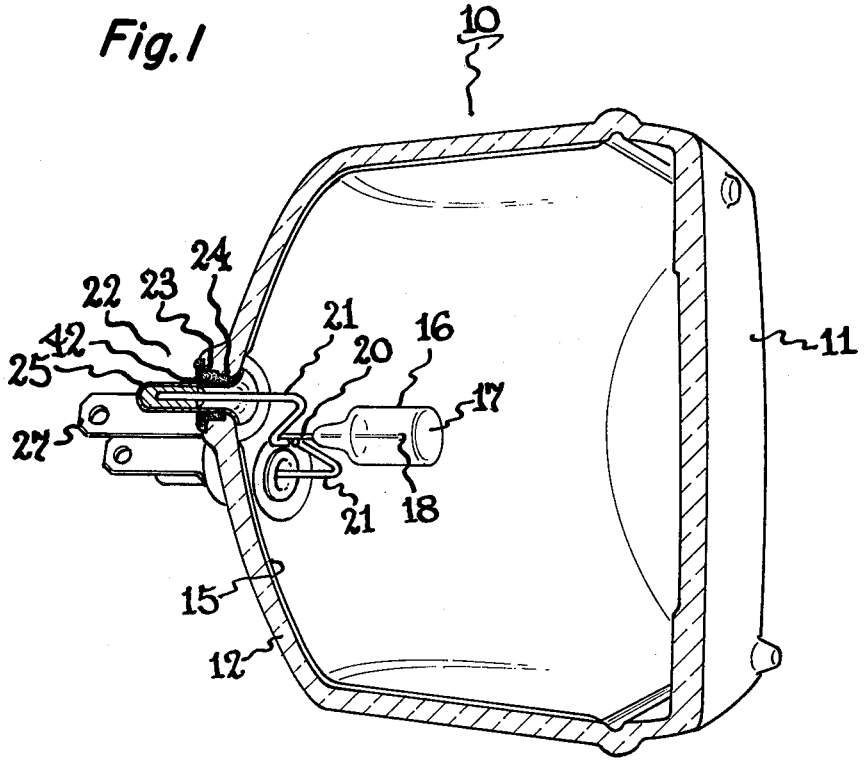
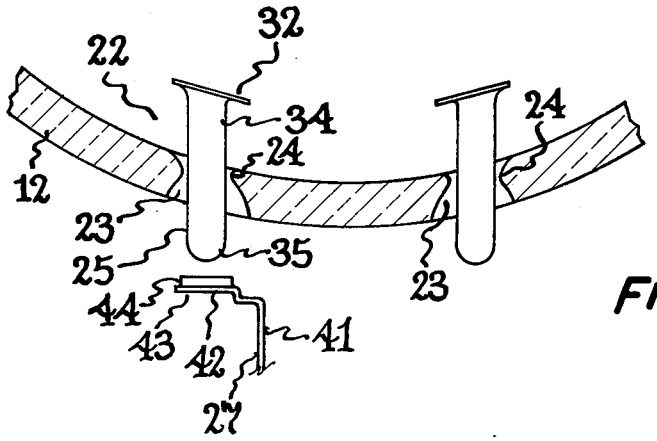
Fig. 2

SEALED BEAM LAMP UNIT HAVING BONDED TERMINALS

This invention relates to sealed beam lamp unit and more particularly to sealed and bonded closed end eyelet lamp terminals which structurally support and electrically connect a light source disposed within an envelope. The lamp terminals are sealed against vapor penetration and prevent contaminants from entering the lamp envelope.

BACKGROUND OF THE INVENTION

Generally, sealed beam lamp units have particular utility as head or auxiliary lamps for vehicles and comprise a glass lens which is hermetically sealed to a glass reflector at their mating peripheral surfaces to form a sealed lamp envelope. A portion of the glass envelope has a reflective coating applied thereto for reflecting visible radiation from a filament through a lens portion of the envelope to form a desired beam pattern. The filament is disposed within the envelope approximately at the focus thereof and is electrically connected by metal lead wires, to a set of lamp terminals which in turn are externally electrically connected to a power source.

Formerly, the rear lamp terminals were formed by embedding the rim of a cup-shaped ferrule in a heat-softened outer surface of a glass envelope boss to provide an hermetically sealed lamp envelope.

More recently, adhesive sealants such as epoxy resins or thermosetting cements have been used to seal lamp envelopes. However, unless the adhesive seal is substantially impervious to moisture penetration the lamp life is unacceptably short because water vapor attacks and degrades the reflectivity of the envelope, the transmissiveness of the lens and in the case of an exposed filament causes premature filament burnout due to the water cycle transport of tungsten from the hot filament to the cooler envelope wall.

Heretofore, adhesively sealed lamp constructions have employed mounting plates having light sources secured thereto which in turn are adhesively sealed in a rear reflector opening. Mounting brackets which are relatively heavy, strain the adhesives and create leak sites which permit moisture to penetrate the lamp.

The mounting plates indirectly position a light source and afford only limited focusing precision. The mounting plates have sockets for receiving a lamp therein or alternatively include channels for receiving lamp lead wires therethrough. Both the bulb-socket and the lead wire-channel constructions provide additional potential leak sites previously unknown in the cup-shaped ferrule-glass boss rear terminal constructions of the prior art.

Present technology suggests metal cladding of the adhesive seals with solder or sheet metal to create tortuous diffusion paths to guard against water vapor penetration. Metal cladding increases material and labor costs without reducing the number of leak sites or their respective cross-sectional areas.

SUMMARY OF THE INVENTION

The present invention provides a bonded lamp terminal which is substantially impervious to water vapor penetration and reduces the number of potential leak sites as well as their respective cross-sectional areas. A bonded lamp terminal in accordance with the present invention includes a closed end eyelet which is bonded by a sealant in an opening through a lamp envelope wall. The eyelet securely engages a lamp lug to establish structural and electrical connection therebetween. Lamp lead wires are embedded or soldered within the eyelet to accurately position a light source relative to the envelope reflector.

The eyelet and lug have surfaces which abuttingly engage respective surfaces of the envelope wall to secure the lamp terminal therethrough. The lug in alternate embodiments includes a collar and is press fitted, crowned or ring-sealed to the eyelet.

A sealant bonds the lamp terminal within the envelope wall and prevents moisture from penetrating the envelope between the lamp terminal and the envelope wall. The sealant is selected from a class consisting of thermoplastic, thermoset or hot melt materials and in a preferred embodiment includes a variety of filters such as silica, aluminum or copper therein.

In a preferred embodiment, the opening in the envelope wall has a restriction such that the outside diameter of the eyelet approximately equals the inside diameter of the wall restriction. The bonded lamp terminal of the present invention is susceptible to water vapor penetration only at restricted envelope wall-eyelet interface. Hence, the present bonded lamp terminal reduces both the number and the cross-sectional areas of leak sites and eliminates the need for further leak proofing.

The lamp unit of the present invention is sealed at both its reflector-lens interface and terminal-reflector interface to effectively guard against the entrance of moisture and thus provides a bonded terminal sealed beam lamp unit having an acceptable lifetime.

In a preferred embodiment, the lamp filament is hermetically sealed within an inner bulb, such as a tungsten halogen envelope, to further isolate the filament from water cycle erosion.

The bonded eyelet terminal of the present invention provides an economical and sealed lamp terminal which is readily adaptable to the techniques and construction presently known in the pressed glass and plastic sealed beam lamp art.

These and other objects and features and a more complete understanding of the aspects of this invention will be apparent from the following detailed description which taken in conjunction with the drawings represents a preferred embodiment of this invention.

BRIEF DESCRIPTION OF THE DRAWINGS

FIG. 1 is a cross-sectional view of a lamp unit made in accordance with the present invention.

FIG. 2 is a cross-sectional view of closed end eyelets being applied through openings in an envelope wall.

DETAILED DESCRIPTION

Figure 3:
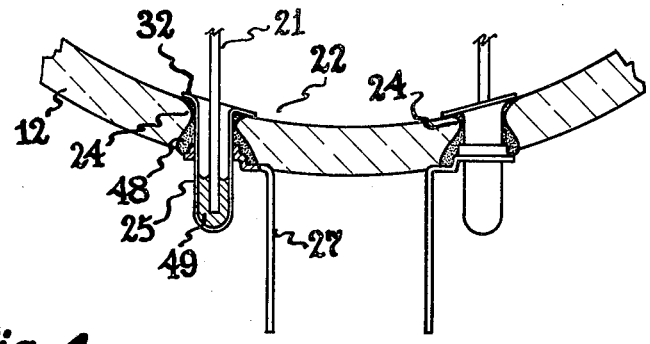
FIG. 3 is a cross-sectional view of the bonded lamp terminals in accordance with the present invention wherein the closed end eyelets are press fitted with lug terminals.

Referring now to FIG. 1, a sealed beam lamp unit 10 in accordance with the present invention is shown partly in cross section. The lamp unit 10 of the present invention can be used in connection with vehicles such as automobiles to provide the principal forward lighting thereof. Although FIG. 1 illustrates a rectangular headlamp, the bonded lamp terminals of the present invention are equally applicable to a variety of conically configured envelopes including but not limited to the circular configuration of U.S. Pat. No. 2,317,031. While the bonded lamp terminal is particularly useful in pressed glass constructions, it is equally useful in plastic constructions disclosed in, for instance, copending application Ser. No. 896,7078, assigned to the assignee of the present invention and incorporated herein by reference.

The sealed beam lamp unit 10 generally comprises a lens 11 and a reflector 12 which are sealed to each other at their mating pheripherial surfaces by fusion or other technique well-known in the art. Fusion sealed envelopes are disclosed in U.S. Pat. Nos. 2,148,314, 2,148,315, 4,076,143 and 4,128,864 assigned to the assignee of the present invention and incorporated herein by reference.

The reflector 12 is generally coated with a reflective material 15 which is applied to the interior thereof for the directional control of light emitted from a light source 16. Although the light source 16 is illustrated as a tungsten halogen lamp, disclosed for instance in U.S. Pat. Nos. 3,798,491 and 4,139,794, assigned to the assignee of the present invention and incorporated herein by reference, an exposed filament 18 is employed in alternate embodiments of the present invention. The inner bulb 17 additionally protects the tungsten filament 18 from water cycle erosion. Light source 16, whether exposed or enclosed, includes a single or multiple filaments 18 with structural and electrical connections made through bonded lamp terminals.

The light source 16 is provided with lead-in wires 20, which are generally molybdenum, with nickel plated iron extensions, hermetically sealed through the inner bulb 17 to provide structural support and electrical connection for the filament 18. Light source lead-in wires 20 are electrically and structurally attached by, for instance spot welding to nickel plated iron lamp lead wires 21 which are generally heavier than light source lead wires 20. The lamp lead wires 21 rigidly support and optimally position the light source 16 within the reflectorized envelope 12, for instance, approximately at the focus thereof to provide the desired beam pattern.

Lamp lead wires 21 are structurally and electrically connected to respective bonded lamp terminals 22 of the present invention which are inserted in the envelope openings 23, shown in more detail in FIG. 2. The envelope openings 23 initially include a thin glass window therein which is subsequently removed during manufacturing to provide a terminal opening 23 having a restriction 24. The interior reflectorized envelope surface 12 includes a non-reflectorized margin about the perimeter of the terminal opening 23 to insure the insulated mounting of the bonded lamp terminal 22.

Each bonded lamp terminal 22 generally comprises a closed end eyelet 25 which is inserted through the terminal opening 23 and electrically and structurally engages a lug 27 to secure the lamp terminal 22 through the lamp envelope 12. The lug 27 additionally provides a means for electrically connecting the lamp 10 to an external power source.

Referring now to FIG. 2, the bonded lamp terminal 22 of the present invention is shown in greater detail. The closed end eyelet 25 is shown passing through the envelope terminal opening 23. The closed end eyelet 25 posteriorly includes a laterally disposed rim 32 which makes an angle (approximately 75°) with the axis of the eyelet which approximates a tangent to the envelope to facilitate abutting contact between the interior surfaces of the envelope wall 12 and the rivet rim 32. Additionally, eyelet 25 comprises a hollow cylindrical shaft 34 which terminates in a closed anterior end 35. The eyelet 25 is brass or a similar metal which is highly conductive, corrosion resistant, impervious to moisture, and possesses appropriate thermal expansion and conduction characteristics which effectively cooperate with the lamp envelope material.

The lug 27 includes a contact 41, a rim 42 having an approximately centrally located opening 43 therein for receiving and engaging a portion of the eyelet 25 therethrough to secure the eyelet 25 through the envelope 12 and electrically connect the eyelet 25 to an external power source. The inside diameter of the lug opening 43 is approximately equal to the outside diameter of the eyelet 25. The eyelet 25, when inserted within the lug 27, forms a tight fit. The lamp lug 27 in a preferred embodiment includes a collar 44 which is axially articulated either anteriorly or posteriorly from the lug rim 42 to extend the structural and electrical connection between the lug 27 and the eyelet 25. The inside diameter of the collar 44 is again approximately equal to the outside diameter of the eyelet 25.

Referring now to FIG. 3, eyelet 25 is shown permanently attached through a lamp envelope 12 by press fitting lug 27 thereon. The outer edges of the eyelet rim 32, as shown, deform slightly during the press fitting to ensure abutting contact between the terminal 22 and the envelope 12. Press fitting the lug 27 to the eyelet 25 additionally insures clean electrical contacts therebetween.

As described above, the envelope wall opening 23 is noncylindrical and is narrowed by a restriction 24 and the inside diameter of the opening 23 at its narrowest point is approximately equal to the outside diameter of the eyelet shaft 34. The close fit between opening restriction 24 narrows the envelope opening 23 with only a small cross-sectional area being left exposed as a potential leak site.

The eyelet-lug connection is bonded, encased or cemented within the terminal opening 23 by a suitable sealant 48 which is substantially impervious to water vapor penetration. The sealant 48 may be a thermoplastic, thermoset or hot melt material. Suitable examples include epoxies, epoxy-urethanes, urethanes, polyesters, silicone rubbers, polysulfides, acrylics, synthetic rubbers, polyamides, ureaformaldehyde, phenolics, melamine formaldehyde, polymidies and polyamide-imides. Other suitable plastic materials include polyolefins, acrylates, polystyrenes, polycarbonates, silicone molding powders and asphalts. Suitable hot melt materials include epoxies, polyesthers, polyurethanes and polyimides. The sealant 48 has a viscosity sufficient to flowably fill the voids between the terminal 22 and the envelope 12 and is curable to a solid material which rigidly seals the terminal 22 against moisture penetration.

The sealant 48 is subject to thermal cycling during both the operation and the manufacture of the lamp and is required to exhibit appropriate thermal conductivity and expansion coefficients. Fillers such as metal or silica powders, granules, or fibers are, in a preferred embodiment, included in a sealant 48 to improve the thermal conductivity, thermal expansion, hardness, and strength of the sealant 48 and the bonded lamp terminal 22. In a preferred embodiment, the fillers are approximately spherical silica, aluminum or copper particles having a mesh size of approximately 40–325 with the smaller mesh size being preferred. Small approximately spherical particles permits the sealant 48 to flow and fill the voids or air pockets which might otherwise be formed within the bonded terminal 22.

The lamp lead wires 21 are structurally and electrically connected within the interior hollow of the eyelet 25. The interior diameter of the eyelet 25 is substantially larger than the outside diameter of the lead wire 21 and the lamp lead wire 21 is positioned within the eyelet 25 such that the light source 16 is optimally positioned or focused with respect to the reflectorized envelope 12. In a preferred embodiment, the lamp lead wires 21 are inserted in molten solder 49 and positioned relative to the terminals 22 and the reflector 12 such that the light source 16 is optimally positioned.

Accordingly, the lamp terminal 22 is a metallic member which substantially fills the entire envelope opening 23. The metallic member is impervious to moisture penetration and is primarily responsible for the hermeticity of the lamp terminal 22. The sealant 48 further completes the hermeticity of the terminal 22 by eliminating voids between the lamp terminal 22 and the envelope wall 12 which might otherwise permit moisture penetration.

Figure 4:
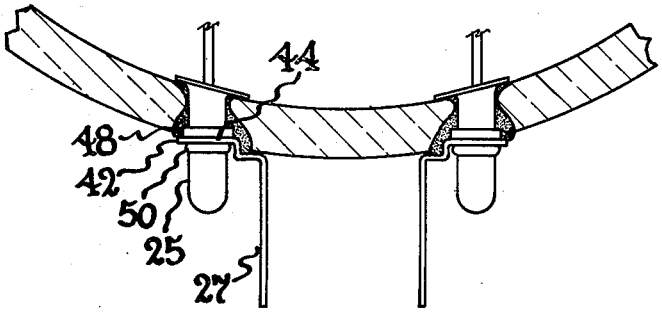
FIG. 4 is an alternate embodiment of the bonded lamp terminals of the present invention wherein the closed end eyelets are deformed to engage lug terminals and secure the lamp terminals through the envelope wall.

Referring now to FIG. 4, the lamp terminal 22 is bonded by the sealant 48 within the lamp terminal opening 23. The lug 27 is not press fitted to the rivet but is alternatively rigidly attached to the eyelet 25 by a ring 50 which is pressed from the interior of the eyelet 25 to protrude over and engages the lug rim 42. The ring 50 in one embodiment is effected by a conventional hydraulically operated ring sealer which is inserted and operated within the eyelet 25.

Figure 5:
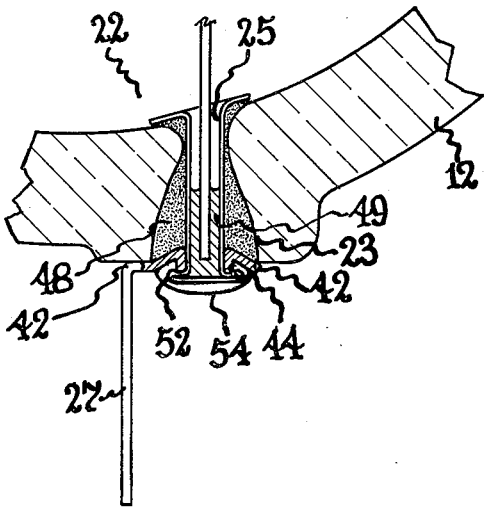
FIG. 5 is an alternate embodiment of the bonded lamp terminal of the present invention wherein the closed end eyelet crowningly engages the lug terminal.

Referring now to FIG. 5, the eyelet 25 is shown in a crowned connection with the lug 27. More particularly, the eyelet 25 is inserted through the envelope opening 23 approximately to the exterior surface thereof. The lug 27, having an anteriorly projecting collar 44, is slipped over the eyelet 25 and the head of the eyelet 25 is subsequently deformed or crowned to produce flange 52 which structurally and electrically engages the lug 27. As shown in FIG. 5, a portion of lug rim 42 is angularly configured to project into the opening 23 and secure the lug 27 in a binding relation with the envelope wall 12 to improve the structural stability of the sealed lamp terminal 22. The eyelet terminal 22 is again bonded by a sealant 48 as described above. The crowned lug terminal of FIG. 5 is, in an alternate embodiment, metallized on its exterior surface by for instance a solder coating 54 to further improve the electrical conductivity of the lamp terminal 22.

It will be appreciated that the present invention provides a simple, quick, economical and moisture impervious lamp terminal for a sealed lamp unit.

So-called sealed terminals of the prior art have employed an open end eyelet to secure a lug terminal to an envelope and provide a channel through the envelope wall for receiving a lamp lead wire therethrough. This construction does not provide an impervious metallic barrier inasmuch as the through eyelet channel is a potential leak site and a substantial quantity of solder is needed to secure and seal the lead wire in the through channel. Solder often cracks during cooling from the molten state or during thermal cycling of the lamp to allow contaminants to penetrate the envelope, degrade the reflector and errode the filament.

In the particular environment of the lamp unit, the present bonded lamp terminal yields surprising advantages. The assembly technique is sufficiently inexpensive that the lamp unit 10 can be produced at a reduced cost without substantially affecting the life or quality of the product. Accordingly, this represents an entirely new concept in seal beam lamps.

Although the invention has been described in its preferred form with a certain degree of particularity, it is understood that the present disclosure of the preferred embodiment has been made only by way of example and that various changes in the details of construction may be resorted to without departing from the true spirit and scope of the invention as hereinafter claimed. It is intended that the patent shall cover, by suitable expression in the appended claims, the patentably novel features of the invention disclosed.

What is claimed is:

1. A sealed beam lamp unit having a bonded lamp terminal comprising:

a lamp envelope including a configured reflector portion sealed to a light-transmissive lens, at least one lamp terminal, encased in sealant and inserted through a wall of said envelope, comprising a hollow closed end eyelet having an anterior rim abutting the interior surface of said envelope, and a posterior portion which engages a lug abutting the exterior surface of said envelope, a light source disposed within said envelope and electrically connected and structurally supported by at least two lead wires at least one of which terminates within and is structurally and electrically secured to said lamp terminal.

2. The sealed beam lamp unit of claim 1 wherein said anterior rim makes an angle of approximately 75° with the axis of the eyelet.

3. The sealed beam lamp unit of claim 1 wherein said lug has a collar for at least partially cylindrically engaging said eyelet.

4. The sealed beam lamp unit of claim 1 wherein said eyelet is inserted through and concentrically engages said lug in a press fit.

5. The sealed beam lamp unit of claim 1 wherein said lamp terminal bindingly engages said envelope.

6. The sealed beam lamp unit of claim 1 wherein said lug is locked onto said eyelet by a ring which protrudes from said eyelet.

7. The sealed beam lamp unit of claim 1 wherein said eyelet is crowned to bindingly engage said lug.

8. The lamp unit of claim 1 wherein said sealant is from the class consisting of thermoplastic, thermoset and hot melt materials.

9. The lamp unit of claim 1 wherein said sealant contains a filler exhibiting high thermal conductivity and selected from the class consisting of silica aluminum and copper.

10. The lamp unit of claim 9 wherein the filler is comprised of approximately spherical particles having a 40–35 mesh size.

11. The sealed beam lamp unit of claim 1 wherein said envelope opening has an inside diameter approximately equal to the outside diameter of said eyelet.

12. The sealed beam lamp unit of claim 1 wherein said lamp lead wires are referentially located and soldered within said rivets.

13. The sealed beam lamp unit of claim 1 wherein the inside diameter of said eyelet is substantially larger than the outside diameter of said lead wire.

14. A lamp terminal for a sealed lamp unit comprising a hollow closed end eyelet which is inserted through an opening in an envelope wall for anteriorly engaging the interior surface of said envelope and posteriorily engaging a lug in binding relation with the exterior surface of said envelope for structurally securing and electrically connecting said eyelet and lug through said envelope wall and effecting a metallic, water vapor impervious barrier within said opening, said barrier being bonded by a sealant within said envelope wall, and a light source electrically and structurally connected by lead wires embedded within said rivets for receiving electrical power therethrough and emitting light in response thereto.

15. The seal beam lamp unit of claim 1 wherein said opening in said envelope wall includes a restriction for narrowly engaging said rivet.

* * * * *